United States Patent [19]

Owen

[11] Patent Number: 4,574,231

[45] Date of Patent: Mar. 4, 1986

[54] MAGNETIC AMPLIFIER APPARATUS FOR BALANCING OR LIMITING VOLTAGES OR CURRENTS

[76] Inventor: Donald W. Owen, 801 Brookwood Dr., Apartment 108, Oklahoma City, Okla. 73139

[21] Appl. No.: 596,726

[22] Filed: Apr. 4, 1984

[51] Int. Cl.[4] ..... G05F 1/335

[52] U.S. Cl. ..... 323/253; 307/14; 323/336; 323/338

[58] Field of Search ..... 307/14; 323/249, 253, 323/329, 335, 336, 338; 330/8

[56] References Cited

U.S. PATENT DOCUMENTS

| | | | |
|---|---|---|---|
| 2,767,372 | 10/1956 | Rowley et al. | 323/336 |
| 2,831,159 | 4/1958 | Guth | 323/336 |
| 2,870,417 | 1/1959 | Rowley | 323/336 |
| 2,923,877 | 2/1960 | McKenney | 323/336 |
| 3,045,126 | 7/1962 | Morgan et al. | 323/259 |
| 3,075,139 | 1/1963 | Balteau | 323/249 |
| 3,292,076 | 12/1966 | Wickenhagen | 323/254 |
| 3,676,766 | 7/1972 | Blackmond | 323/239 |
| 3,938,030 | 2/1976 | Cornwell | 323/253 |
| 3,991,359 | 11/1976 | Thompson et al. | 323/241 |
| 4,352,026 | 9/1982 | Owen | 323/253 |

*Primary Examiner*—William H. Beha, Jr.
*Assistant Examiner*—Jeffrey Sterrett
*Attorney, Agent, or Firm*—E. Harrison Gilbert, III

[57] ABSTRACT

An apparatus for controlling electrical characteristics in an alternating current system includes a first level of magnetic amplifiers which are responsive to a primary direct current control signal. The magnetic amplifiers provide secondary control signals in response to the primary control signal. The secondary control signals control a second level which includes a magnetic amplifier having gate windings to which the alternating current to be controlled is connected. Depending upon the nature of the primary control signal, the current magnitude or voltage magnitude of the alternating current can be controlled, both in relation to other alternating currents and in relation to a predetermined current or voltage magnitude.

27 Claims, 7 Drawing Figures

MAGNETIC AMPLIFIER APPARATUS FOR BALANCING OR LIMITING VOLTAGES OR CURRENTS

BACKGROUND OF THE INVENTION

This invention relates generally to apparatus for controlling a time-varying electrical signal and more particularly, but not by way of limitation, to apparatus for controlling currents and/or voltages in a multi-phase power system.

In a three-phase power system, for example, to which a three-phase motor is connected for energization, many problems can arise which degrade the system and the operation and life of the motor. For example, when the motor is started, significant electrical and mechanical stresses are imposed on the motor because of the high starting currents normally used to start the motor. For example, there are electric submersible motors which have a starting current of six to eight times the nominal rating. Such high starting currents cause the system voltage to sag and thereby affect not only the motor, but also other electronic circuits on the system.

Even after a motor is started, significant stresses can be applied to the motor due to unbalanced operating currents. These unbalanced currents can cause excessive heating and increased power consumption. Also during operation, electrical transients can occur in the system, such as from lightning or switching surges. These undesirable operating conditions adversely affect not only the electrical load, but also the overall system.

The foregoing illustrates the need for an apparatus which eliminates electrical system imbalances, whether they be current imbalances or voltage imbalances. There is also the need for an apparatus to eliminate or reduce electrical transients. There is the further need for an apparatus which allows the soft-starting of electrical loads, such as motors, to reduce excessive stresses imposed upon such loads during start-up. If these needs were met, the operating life and dependability of electrical loads could be increased and power consumption could be reduced.

An apparatus which meets such needs should be electrically and mechanically dependable and efficient to enhance the structural, operational and economic features of such an apparatus. Such an apparatus should also be capable of being installed and removed from the power system without causing expensive downtime of the system. Such an apparatus should also be capable of use without additional step-up transformers and with a minimum of special training for installation and maintenance.

SUMMARY OF THE INVENTION

The present invention meets the aforementioned needs by providing a novel and improved apparatus for controlling a time-varying electrical signal. By limiting maximum current levels, the present invention can be used to soft-start a motor, for example, thereby reducing the stresses caused by higher starting currents. The present invention can also be used to automatically limit maximum voltages, and it can be used to balance currents or voltages regardless of the cause of the imbalance. The present invention can be used to suppress electrical transients. Therefore, utilization of the present invention enhances load life and dependability and reduces power consumption.

The apparatus of the present invention meets these needs in a manner which is electrically and mechanically dependable and efficient. The present invention is capable of installation and removal without expensive downtime. The present invention can be used without additional step-up transfomrers and without special training for installation or maintenance.

Broadly, the apparatus of the present invention comprises first variable impedance means for providing first and second electrical paths through which electrical currents can flow, each of these first and second paths having a respective impedance which is variable in response to a control signal. The apparatus also includes second variable impedance means for providing a third electrical path having an impedance which is variable in response to currents flowing through the first and second paths. The third electrical path is constructed to have the time-varying electrical signal which is to be controlled flowing therethrough. There is one of each of these variable impedance means for each phase when the present invention is used with a multi-phase power system.

Also included in the present invention is control signal means for providing the aforementioned control signal to the first variable impedance means.

Through the operation of this apparatus, currents or voltages within the system can be balanced and can be limited to predetermined values as will be more particularly described hereinbelow.

Therefore, from the foregoing, it is a general object of the present invention to provide a novel and improved apparatus for controlling the magnitude of a time-varying electrical signal. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 6 is a schematic circuit diagram showing three sections of variable impedance means having an alternate scheme of control windings associated with a control signal means by which voltages between the phases of the three-phase power system can be balanced.

DETAILED DESCRIPTION OF THE PREFERRED EMBODIMENTS

Figure 1:
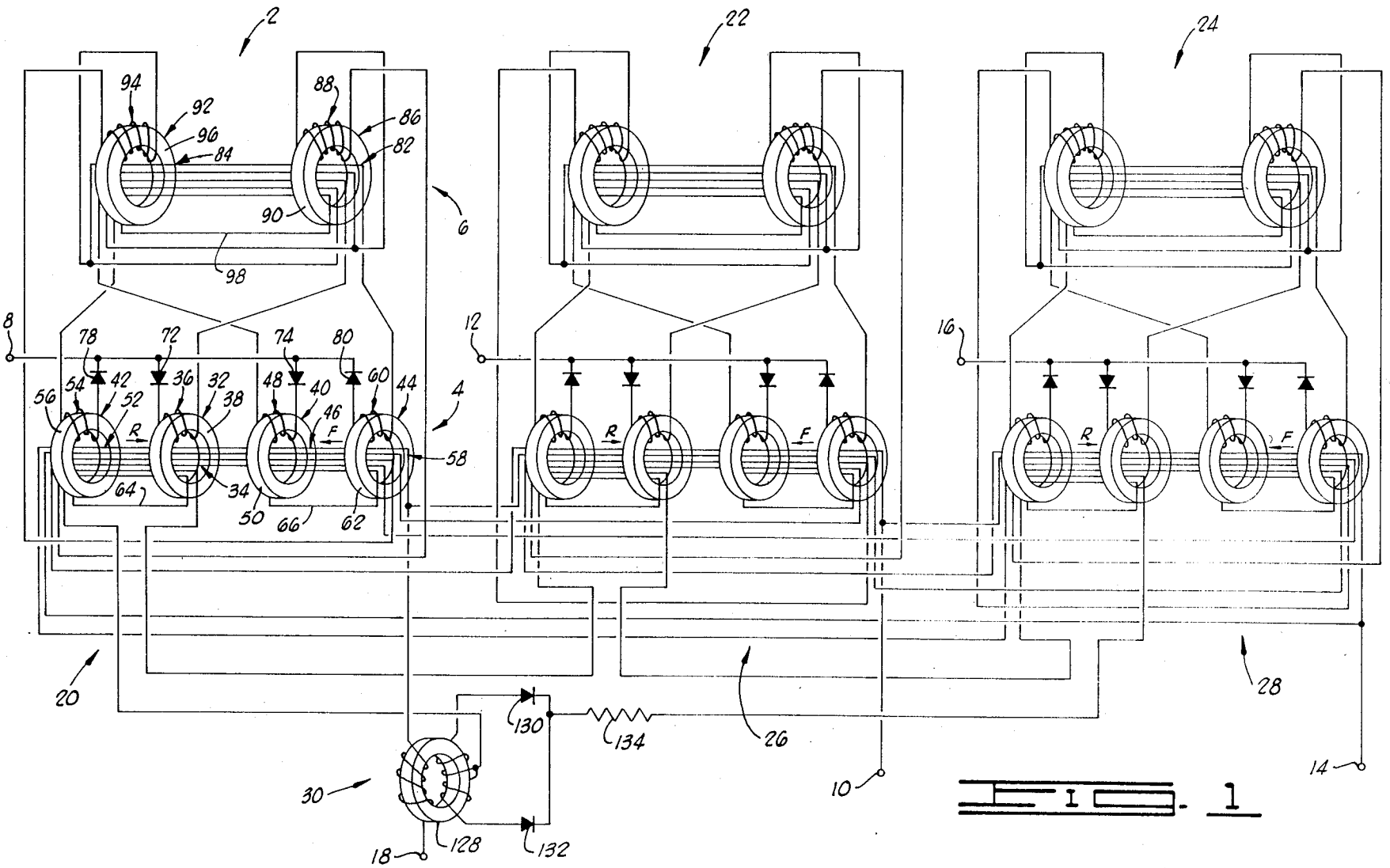
FIG. 1 is a schematic circuit diagram of a first preferred embodiment of the present invention for use in balancing currents in a three-phase power system.

With reference to the drawings, the preferred embodiments constructed in accordance with the present invention will be described. Initially, the broad aspects of the present invention will be described with reference to one section of FIG. 1, which section is designated by the reference numeral 2. Subsequently, a more detailed description of the illustrated specific embodiments will be given.

Section 2 of the FIG. 1 embodiment includes a first variable impedance means 4 and a second variable impedance means 6. The variable impedance means 4 provides two electrical paths through which electrical current can flow. Each of these electrical paths has a respective impedance which is variable in response to a control signal which can be supplied by a suitable control signal means for providing an effectively direct current to the variable impedance means 4. This effectively direct current is used to control a time-varying electrical signal flowing through an electrical path provided by the second variable impedance means 6. This last mentioned electrical path has an impedance which is variable in response to current flowing through the first two aforementioned electrical paths.

The first two aforementioned electrical paths are connected by suitable means to a source of electrical current, which source can be one or more independent means for providing an electrical current. The currents flowing through these first two aforementioned electrical paths are affected by impedance changes in these paths brought about by the control signal which is associated with the variable impedance means 4. Such affected currents flow through suitable connector means which are connected to the variable impedance means 6. Such currents control the impedance of the third aforementioned electrical path. The variation of the impedance in this electrical path in turn affects the time-varying electrical signal which is connected by suitable means to this third electrical path found in the variable impedance means 6.

These elements, and others, found in the specific embodiments shown in FIGS. 1–7 will next be described. The subsequently described embodiments are contemplated to be used with a three-phase power system (not shown) having three phase lines or conductors as known to the art, which phase lines or conductors carry the three phase currents of the three-phase power system. However, the present invention is not limited to use in three-phase power systems.

The FIG. 1 embodiment of the present invention is connected within the three-phase power system by connecting terminals 8, 10 to one phase line or conductor between the power source and load, by connecting terminals 12, 14 to a second phase line or conductor between the power source and load, and by connecting terminals 16, 18 to a third one of the phase lines or conductors between the power source and the load. Because each of the phase lines in a three-phase power system carries an alternating, or time-varying, electrical signal, the terminals 8, 12, 16 can be considered as input terminals and the terminals 10, 14, 18 can be considered output terminals, or vice versa.

The embodiment illustrated in FIG. 1 includes a phase control means for controlling the phase current of the phase line which is connectible to the terminals 8, 10. This phase control means is identical to the section 2 previously described; therefore, this phase control means will be likewise designated by the numeral 2. Associated with this phase control means 2 is a control signal means 20 for providing a net direct current control signal to the phase control means 2.

The FIG. 1 embodiment includes two other phase control means 22, 24 constructed similarly to the phase control means 2. The FIG. 1 embodiment also includes two other control signal means 26, 28 which are similar to the control signal means 20.

Still another part of the FIG. 1 embodiment is a pre-biasing means 30.

The aforementioned elements will be more particularly described by looking at the detailed structure of the phase control means 2, the control signal means 20, and the pre-biasing means 30 shown in FIG. 1 along with alternate embodiments of these elements illustrated in FIGS. 2–7. In describing alternate embodiments, elements which correspond to similar elements or portions of the FIG. 1 embodiment are designated with like reference numerals, but with lower case letters added.

The phase control means 2 includes the aforementioned variable impedance means 4 which includes a control reactor 32 having a control winding 34, a gate winding 36, and a core 38 which electromagnetically couples the control winding 34 with the gate winding 36. The impedance imposed upon a circuit into which the gate winding 36 is connected is responsive to a direct current signal in the control winding 34.

The variable impedance means 4 includes three other control reactors identified by the reference numerals 40, 42, 44. The control reactor 40 includes a control winding 46, a gate winding 48, and a core 50 electromagnetically coupling the control winding 46 and the gate winding 48. The control reactor 42 includes a control winding 52, a gate winding 54, and a core 56 electromagnetically coupling the control winding 52 and the gate winding 54. The control reactor 44 is similarly constructed with a control winding 58, a gate winding 60, and a core 62.

Associated with the control reactor 32 and the control reactor 42 is a short-circuit means, such as a conductor 64, for eliminating alternating current flux components in the control windings of these two control reactors. A similar short-circuit means, such as a conductor 66, is associated with the control reactors 40, 44.

The related control reactors 32, 42 as shown in FIG. 1 specifically define in the preferred embodiment a magnetic amplifier of a type as known to the art. This type of magnetic amplifier is also called a saturable reactor with blocked intrinsic feedback. With respect to this magnetic amplifier construction, the impedance provided thereby in the illustrated embodiment is inductive impedance, as distinguished from capacitive or resistive impedance. The control reactors 40, 44 likewise are related as illustrated in FIG. 1 to form a magnetic amplifier which provides controllable inductive impedance. In the FIG. 1 embodiment the gate windings 36, 54 of the first mentioned magnetic amplifier form parts of one of the initially aforementioned first two electrical paths, and the gate windings 48, 60 of the other magnetic amplifier form parts of the other of these two electrical paths.

As shown in FIG. 1, the control windings 34, 46, 52, 58 are associated with the control signal means 20 so that the control signals therefrom flow through these control windings. Although these control windings are shown effectively as a multi-conductor, single-loop winding passing through all four control reactors 32, 40, 42, 44, other winding schemes as known to the art can be used (see, for example, FIGS. 6 and 7).

Figure 4:
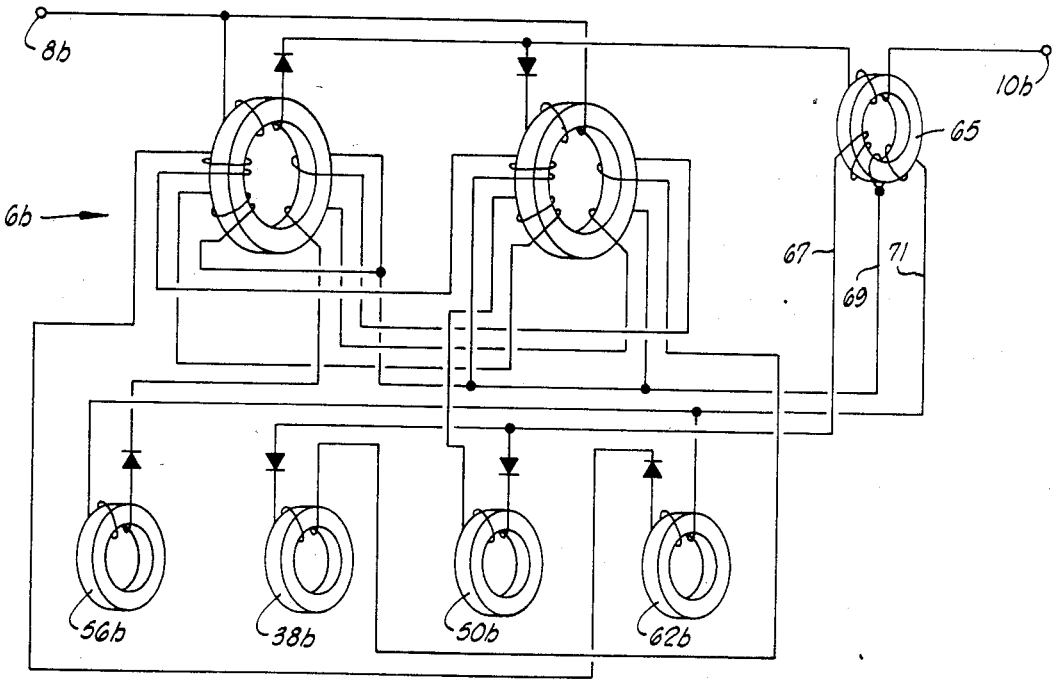
FIG. 4 is a schematic circuit diagram showing an alternate power source for one section of another variable impedance means of the present invention.

The gate windings 36, 48, 54, 60 have ends thereof connected to receive a respective current via suitable connector means. In the FIG. 1 embodiment, this connector means includes first rectifier means and second rectifier means which connect the respective gate windings with the phase line with which the phase control means 2 is associated. It is to be noted, however, that in other embodiments the gate windings can be connected to other sources of current which can be related to or independent of each other or the time-varying signal to be ultimately controlled by the present invention. One example of an alternate source of current is shown in FIG. 4 wherein a current transformer 65 provides a current via conductors 67, 69, 71 which is proportional to the phase current flowing between terminals 8*b*, 10*b*.

The first rectifier means of the preferred embodiment shown in FIG. 1 includes a diode 72 and a diode 74. In the FIG. 1 embodiment, each of the diodes 72, 74 has its anode connected to the terminal 8 for connection to the phase line with which the phase control means 2 is associated. The diode 72 has its cathode connected to an end of the gate winding 36, and the diode 74 has its cathode connected to an end of the gate winding 48. The diode 72 is connected to the gate winding 3i so that the flow of current through the gate winding 36 relative to the core 32 is opposite the direction in which current flows through the gate winding 48, via the diode 74, relative to the core 50.

Figures 5, 7:
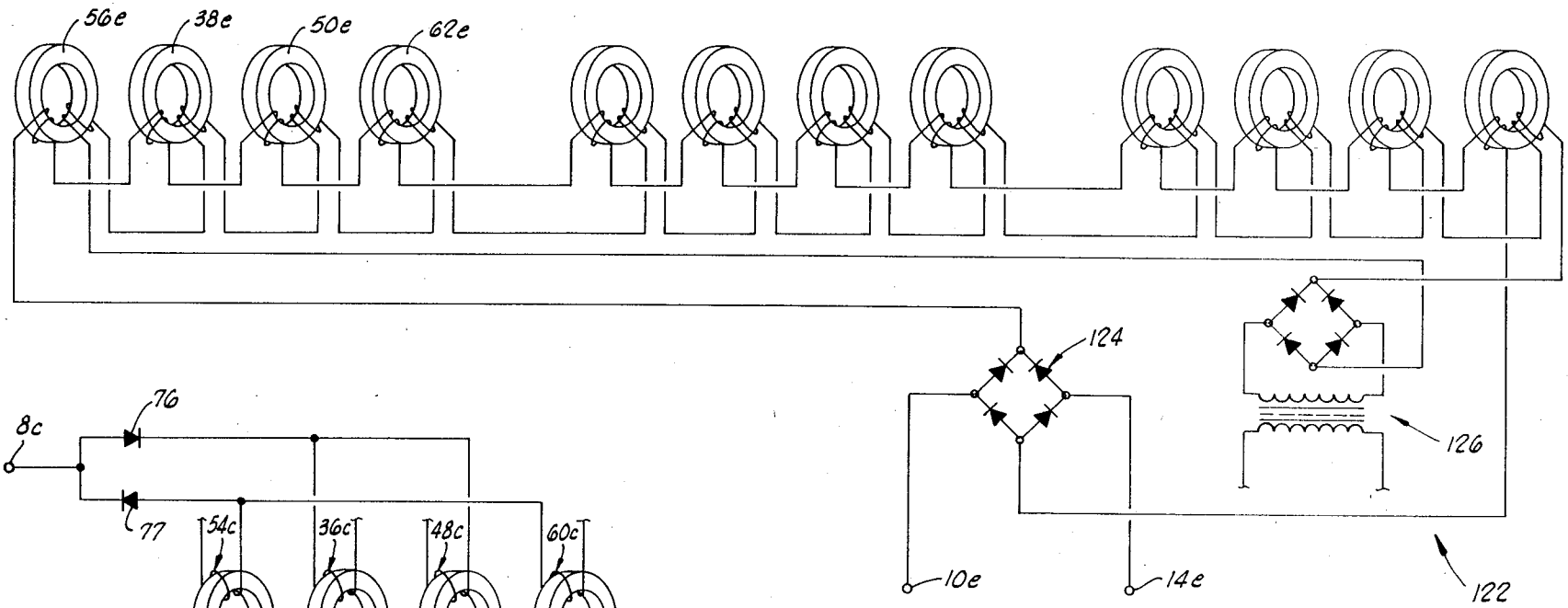
FIG. 5 is a schematic circuit diagram showing one alternate rectifier means to the rectifier means shown in the FIG. 1 embodiment.
FIG. 7 is a schematic circuit diagram similar to that shown in FIG. 2, but showing parts of three sections of variable impedance means associated with control signal means for limiting the maximum magnitude of voltage between each of the phases of the three-phase power system.
Figure 5:
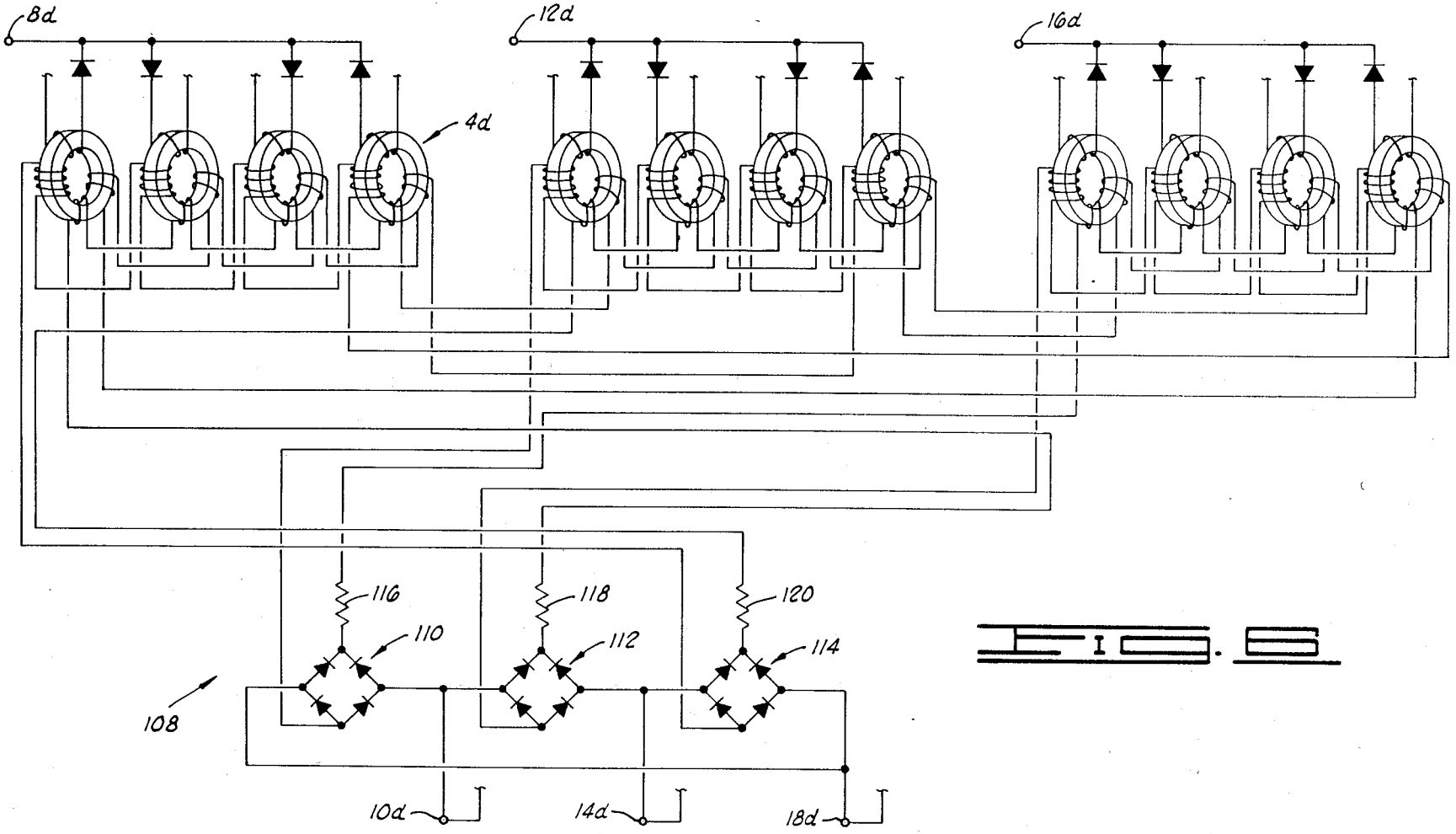

FIG. 5 shows than an alternate embodiment of the first rectifier means includes a single diode 76. The cathode of the diode 76 is appropriately connected to the illustrated gate windings 36*c*, 48*c* shown in FIG. 5 so that the aforementioned opposite current flow relative to the two respective cores 38*c*, 50*c* is achieved.

With either of the foregoing constructions depicted in FIGS. 1 and 5, the rectifier means comprising the described diode(s) rectififes alternating current flowing through the terminal to which the anode(s) of the diode(s) are connected and splits the rectified current to flow through either or both of the gate windings of the respective control reactors. The quantity of current flowing through each gate winding is determined by the impedance of the respective gate winding as controlled by the control signal flowing through the associated control windings. This construction provides two variable impedance electrical paths through which current flows in the variable impedance means 4.

The preferred embodiment of the second rectifier means shown in FIG. 1 includes a diode 78 and a diode 80. An alternate embodiment containing a single diode 77 is illustrated in FIG. 5 wherein the diode 77 has its anode connected to the gate windings 54*c*, 60*c* for opposite current flow relative to the respective cores 56*c*, 62*c*. The diodes 78, 80 in the FIG. 1 embodiment have their respective cathodes connected to the terminal 8 and thus to the phase line with which the preferred embodiment phase control means 2 is associated when the terminals 8, 10 are connected thereto. The anode of the diode 78 is connected to an end of the gate winding 54, and the anode of the diode 80 is connected to an end of the gate winding 60. These anode connections of the diodes 78, 80 are such that the current flow through the gate winding 54 is in a direction relative to the core 56 which is opposite the direction current flows through the gate winding 60 relative to the core 62. With this construction, the control reactor 42 and the control reactor 44 operate similarly to the control reactor 32 and the control reactor 40, respectively, except that the control reactors 42, 44 operate during a different part of the cycle of the alternating current flowing between the terminals 8, 10 which, in the preferred embodiment, is the phase current associated with the phase control means 2. Therefore, in the illustrated preferred embodiment the variable impedance gate windings 54, 60 also form respective parts of the aforementioned two electrical paths in the variable impedance means 4.

The control reactor 32 and the control reactor 42 and their respective diodes 72, 78 form part of a reverse bias control mechanism of the present invention. The control reactor 40 and the control reactor 44 and their respective diodes 74, 80 comprise part of a forward bias control mechanism. The operation of these control mechanism will be more fully described hereinbelow with reference to the operation of the present invention.

The other ends of the gate windings 36, 48, 54, 60 which are not connected to the respective diodes 72, 74, 78, 80, are connected to control windings 82, 84 found in the variable impedance means 6. The variable impedance means 6 of the preferred embodiment includes a main reactor 86 having the control winding 82, a gate winding 88, and a core 90 electromagnetically coupling the control winding 82 with the gate winding 88. The variable impedance means 6 also includes a main reactor 92 having the control winding 84 electromagnetically associated with a gate winding 94 by means of a core 96. The main reactors 86, 92 are linked by a short-circuit means, such as a conductor 98, for eliminating alternating current flux components in the control loops of the variable impedance means 6. These elements are respectively combined to form a magnetic amplifier of a type as known to the art and which is functionally similar to those found in the variable impedance means 4.

FIG. 1 more particularly discloses that the interconnections between the gate windings of the variable impedance means 4 and the control windings of the variable impedance means 6 are such that opposing currents flow in the control windings 82, 84. In particular, the gate winding 36 and the gate winding 54 of the control reactors 32, 42, respectively, are connected to the control windings 82, 84 so that current flows therethrough in one direction relative to the cores 90, 96 and their associated gate windings 88, 94. This direction is from right to left as viewed in FIG. 1. This direction of current flow is in opposition to the flow of a current passing through the gate windings 88, 94. Conversely, the gate windings 48, 60 of the control reactors 40, 44, respectively, are connected to the control windings 82, 84 so that current flows in an opposite direction relative to the cores 90, 96 and their associated gate windings 88, 94. As viewed in FIG. 1, this opposite direction is from left to right which is in a direction that aids the flow of current through the gate windings 88, 94. The significance of this construction is more particularly described hereinbelow with reference to the operation of the present invention.

By means of the connection scheme shown in FIG. 1, the gate windings 88, 94 are connected to conduct the phase current at different portions of each cycle of the phase current when the phase line carrying the phase current is connected to the terminals 8, 10. That is, during one part of each cycle of the phase current, current is present in the gate winding 88, and during a different part of each cycle, phase current is present in the gate winding 94. The magnitudes of these portions of the phase current are controlled by the impedance presented by the gate winding 88 or the gate winding 94 in ultimate response to the control signal provided by the control signal means 20.

The control signal means 20 of the FIG. 1 embodiment includes the illustrated conductors which connect various rectified portions of each of the three phases to the control windings of the variable impedance means 4 to provide a net direct current when the phase currents are unbalanced. For the FIG. 1 construction of the control signal means 20, this net direct current ultimately controls the phase current passing through the gate windings of the variable impedance means 6 based upon a comparison of all three phase currents. If the three phase currents are balanced, no net direct current appears in the control windings of the variable impedance means 4. If the phase currents are unbalanced, a net direct current flows and increases or decreases the impedances in the gate windings 36, 48, 54, 60 of the variable impedance means 4. The increases or decreases in the impedances in these gate windings affect the net current passing through the control windings 82, 84 of the variable impedance means 6, thereby controlling the impedances in the gate windings 88, 94 of the main reactors 86, 92 and the phase current flowing therethrough. The construction of each of the control signal means in FIG. 1 provides the type of control by means of which the three phase currents can be balanced so that the magnitudes of the phase currents are equalized.

As previously noted, the control signal means of the present invention can, in general, provide any suitable direct current signal; it need not be one related to the time-varying electrical signal controlled by the present invention. Three other embodiments of control signal means are illustrated in FIGS. 2, 6 and 7.

Figure 2:
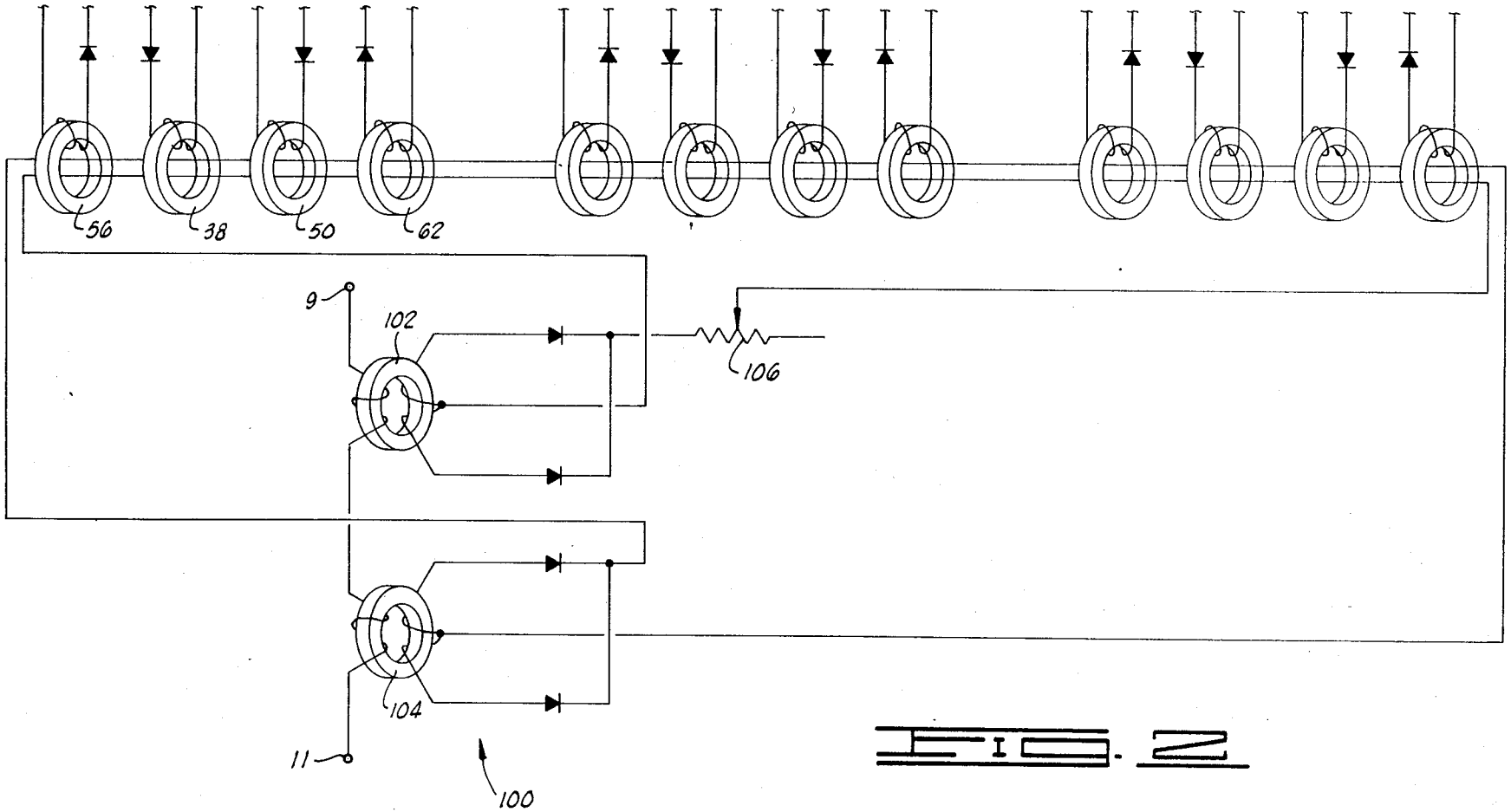
FIG. 2 is a schematic circuit diagram of a portion of the configuration shown in FIG. 1 but having a control signal means associated therewith by which the maximum magnitude of the system currents can be limited.

The FIG. 2 embodiment illustrates a control signal means 100 which, as indicated by the control reactor cores 38, 50, 56, 62, can be used as a part of the specific embodiment shown in FIG. 1; however, the control signal means 100 can also be used without the specific current-balancing embodiment shown in FIG. 1. For use with the FIG. 1 embodiment, the control signal means 100 can be connected in electrical series with either the terminal 8 or the terminal 10. For example, a terminal 9 shown in FIG. 2 can be connected to the terminal 10 shown in FIG. 1 or a terminal 11 shown in FIG. 2 can be connected to the terminal 8 shown in FIG. 1. In the former configuration the terminal 11 would become the output or load terminal in one specific use of the invention, and in the latter configuration the terminal 9 would become the input or supply terminal in one specific use of the invention.

The illustrated control signal means 100 comprises a current transformer 102 and a current transformer 104. The current transformer 102 provides a reference current via a variable resistance, such as rheostat 106. By appropriately adjusting the rheostat 106, a predetermined reference current can be established. This reference current flows through the control windings of the variable impedance means 4 and the corresponding ones thereof found in the other two phase control means 22, 24 as illustrated in FIG. 2. The current transformer 104 provides an effective direct current proportional to the current flowing between terminals 9, 11 (which, in the aforementioned example, would be the phase current). The current established by the rheostat 106 and the current established by the current transformer 104 flow in opposition to each other so that the control signal means 100 acts as a comparison means for comparing the proportional current to the predetermined current limit. When the current flowing between the terminals 9, 11 causes the proportional current from the current transformer 104 to exceed the predetermined effective direct current magnitude established by the rheostat 106, a net direct current signal is provided which causes the phase control means 2, 22, 24 to limit the respective currents flowing through the gate windings of the variable impedance means 6 and the corresponding ones thereof. The control signal means 100 enables the present invention to be used to soft-start a load, such as a motor, connected to the three-phase power system with which the present invention can be used. The control signal means 100 can be used either with or without the current balancing type of control signal means shown in FIG. 1.

FIG. 6 discloses a control signal means 108 for balancing the voltages between the phases. The control signal means 108 is to be used independently of the control signal means 20, 26, 28 of the FIG. 1 embodiment because both currents and voltages cannot be balanced simultaneously; the FIG. 6 embodiment can, however, be used with either or both of the control signal means illustrated in FIGS. 2 and 7. The control signal means 108 includes full-wave rectifiers 110, 112, 114 and resistors 116, 118, 120 which establish direct currents proportional to the phase voltages. These direct currents are provided to the control windings of the illustrated variable impedance means **4*d* and the corresponding ones thereof found in the other phase control means. The control windings shown in FIG. 6 are in a configuration different from the control windings shown in FIG. 1**. However, this alternate construction ultimately controls the impedances of the gate windings in the respective main reactors.

FIG. 7 discloses a control signal means 122 for limiting the maximum magnitude of the phase voltages. One specific use of the control signal means 122 is as a voltage regulator. The control signal means 122 can be used alone or in combination with the other types of control signal means illustrated in FIGS. 1, 2 and 6. The FIG. 7 embodiment functions similarly to the one shown in FIG. 2, except that the current signal means 122 shown in FIG. 7 achieves voltage limiting rather than current limiting. The control signal means 122 includes a full-wave rectifier 124 which establishes a current in a first direction through the control reactors having the illustrated cores **38*e*, 50*e*, 56*e*, 62*e* and the illustrated corresponding cores of the other phase control means. The control signal means 122 also includes a predetermined regulated voltage source 126 which establishes a current in an opposite direction through the control reactors so that when the currest established by the full-wave rectifier 124 exceeds the current established by the regulated voltage source 126**, the phases are controlled to limit the maximum magnitudes of the phase voltages.

Although four specific embodiments of suitable control signal means are disclosed herein, it is contemplated that other types of control signal means can be utilized.

Referring again to the FIG. 1 embodiment, the pre-biasing means 30 will be described. The pre-biasing means 30 of the FIG. 1 embodiment includes a current transformer 128 which provides an effectively direct current through diodes 130, 132 and a resistor 134, which current flows through the control reactors 32, 42 and the corresponding ones thereof found in the phase control means 22, 24. This structure negatively biases these control reactors when the phase currents are balanced. This negative bias causes these control reactors to have relatively high impedances, thereby limiting the flow of current through their respective gate windings. This pre-biasing in effect turns off the controlling mechanism of the present invention when the phase currents are balanced.

Figure 3:
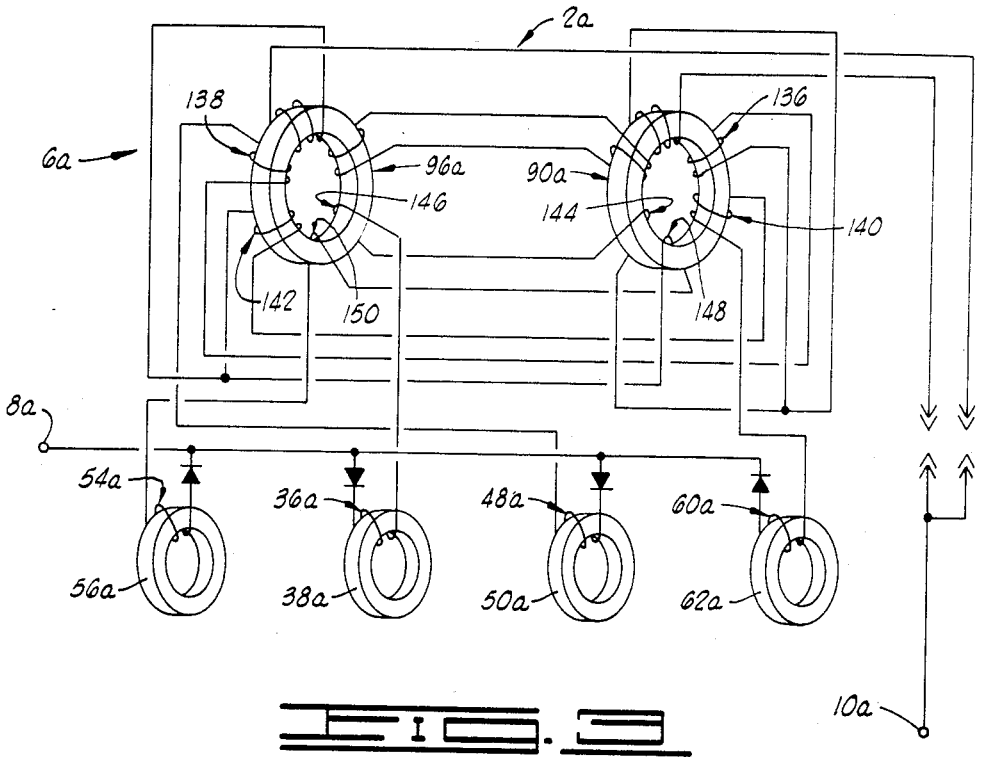
FIG. 3 is a schematic circuit diagram showing an alternate winding scheme of the control windings in one section of a variable impedance means of the present invention.

The specific embodiment of the pre-biasing means 30 shown in FIG. 1 can be replaced by suitable alternate devices such as a permanent magnet located adjacent the control reactors 32, 42 and the corresponding ones thereof found in the phase control means 22, 24. Another alternate embodiment of the pre-biasing means is shown in FIG. 3. In the FIG. 3 embodiment, the pre-biasing of the illustrated section is achieved by constructing control windings 136, 138, 140, 142 of the variable impedance means 6*a*, which windings conduct the forward biased currents from the control reactors having the illustrated cores 50*a*, 62*a*, of a larger conductor and with more turns relative to respective cores 90*a*, 96*a* than are the conductors with which reverse-bias conducting control windings 144, 146, 148, 150 of the variable impedance means 6*a* are constructed. With this construction, the main reactors having the cores 90*a*, 96*a* have more forward bias turns than reverse bias turns which causes the main reactors to be forward biased when the control reactors having the cores 38*a*, 50*a*, 56*a*, 62*a* are unbiased (i.e., when the phase currents are balanced). Because the conductors of the forward biased section are larger than the conductors of the reverse biased section, but of more turns, approximately equal amounts of current will flow through each of the gate windings 36*a*, 48*a*, 54*a*, 60*a* of the control reactors and thus through the control windings 136–150 of the main reactors.

As is apparent from an examination of the illustrated embodiments set forth in FIGS. 1–7, the phase control means 22, 24 are constructed similarly to the phase control means 2. Likewise, the control signal means 26, 28 are similar to the control signal means 20. Therefore, no detailed description of these portions will be given.

OPERATION OF THE PRESENT INVENTION

With reference to the FIG. 1 embodiment, the operation of the present invention as used as a current balancing apparatus will be described first.

When the phase currents of the three phases are balanced, the pre-bias means 30, or some equivalent structure, causes the reverse bias control mechanisms of the phase control means 2, 22, 24 to have relatively high impedances so that the main reactors of the phase control means are not controlled to limit any one of the phase currents. More particularly, during such "balanced" operation the forward bias control mechanisms of the phase control means 2, 22, 24 conduct sufficiently more current than do the reverse bias control mechanisms so that the main reactors are saturated, thereby presenting relatively low, "non-corrective" impedances to the phase currents flowing through the gate windings of the main reactors.

When one of the currents is unbalanced, the effect of the pre-bias means 30 is overcome so that control occurs. Assuming that a phase current A associated with the phase control means 2 is higher than two phase currents B and C which are balanced and associated with phase control means 22, 24, respectively, this situation creates, in the variable impedance means 4 of the phase control means 2, a net direct current flowing in the reverse direction which is designated in FIG. 1 by an arrow and the letter "R." This net direct current causes the gate windings 36, 54 to have relatively low impedances, and it causes the gate windings 48, 60 to have relatively high impedances. During part of a cycle of the phase current A, the diodes 72, 74 are conductive so that the alternating current flowing between terminals 8, 10 is rectified and split between the relatively low impedance gate winding 36 and the relatively high impedance gate winding 48. Because of the lower impedance of the gate winding 36, more current flows through the gate winding 36 than through the higher impedance gate winding 48. This greater current flow through the gate winding 36 causes a net direct current flow from right to left (as viewed in FIG. 1) in the control windings of the main reactors 86, 92. This net direct current in the main reactors 90, 92 causes a higher impedance to be established in the gate windings 88, 94. This higher impedance impedes the phase current A flowing through the gate winding 88 during this portion of the phase current A cycle which is causing the diodes 72, 74 to be conductive. During the other part of each cycle of the phase current A, the diodes 72, 74 become non-conductive; however, the diodes 78, 80 become conductive. This establishes, via the control reactors 42, 44, a similar type of control of the phase current A which flows through the gate winding 94 during this part of its cycle.

Therefore, in the FIG. 1 embodiment each phase controls itself within the main reactors; however, basic or fundamental control is from the net differential of the currents flowing in the control signal means 20, 26, 28.

With reference to the FIG. 2 embodiment, the control achieved by the control signal means 100 is the limiting of the maximum magnitude that any phase current can achieve. This is done through the previously described operation of the illustrated control signal means 100 which provides a comparison between a current proportional to a selected one of the phase currents and a predetermined current established by the rheostat 106.

The FIG. 6 embodiment operates in a similar manner as between the level of control reactors and the level of main reactors; however, control in the FIG. 6 embodiment is based upon the phase voltages. This results in the phase currents being controlled so that the phase voltages are balanced.

The FIG. 7 embodiment functions in a manner similar to the FIG. 2 embodiment, except that the controlling currents are based upon a comparison between a phase voltage and a predetermined voltage so that the phase voltages can be limited to a predetermined maximum level.

Therefore, from the foregoing, it is apparent that the present invention provides an apparatus by which currents can be balanced, voltages can be balanced, maximum current magnitudes can be limited, and maximum voltage magnitudes can be limited. Through the operation of the current magnitude limiting mechanism, soft-starts for loads, such as motors, can be achieved. Through the operation of the maximum voltage magnitude limiting mechanism, voltage regulation can be provided by the present invention. Because the preferred embodiments of the present invention utilize magnetic fields in grain-oriented silicon steel, these controls of electrical power are performed in an efficient and reliable manner.

Balancing of currents or voltages is achieved in the illustrated preferred embodiments by sensing differences between phase currents or between currents proportional to phase voltages and by converting the differentials into individual phase compensations. The cause of any unbalance in either the currents or voltages is irrelevant because the present invention automatically compensates for any cause of imbalance.

The soft-starting feature of the illustrated preferred embodiments is provided by the rheostat 106 shown in the FIG. 2 embodiment. By adjusting the setting of the rheostat 106, the current levels are adjustable from no softening to very soft.

The present invention is also capable of suppressing transients. This can be effected by connecting capacitors (not shown) across the load terminals (for example, terminals 10, 14, 18). This establishes an L-C filter because the windings in the reactors are wound around iron cores which create iron core inductors that are reluctant to conduct transient currents. The combination of the iron core inductances and the capacitances provide a transient suppressor.

With the present invention, relatively small control currents and control reactors can be used to control relatively large currents flowing in relatively larger main reactors.

Thus, the present invention is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. An apparatus for controlling the magnitude of an alternating current electrical signal, said apparatus comprising:

first variable impedance means for providing first and second electrical paths, each of said first and second electrical paths having a respective impedance which is variable in response to an effectively direct current control signal;

connector means for connecting each of said first and second electrical paths with a source of electrical current so that alternating electrical currents can flow through each of said first and second electrical paths;

second variable impedance means for providing a third electrical path having an impedance which is variable in response to currents flowing through said first and second electrical paths; and connecting means for connecting said alternating current electrical signal to said third electrical path so that the magnitude of said alternating current electrical signal is controllable by varying the impedance of said third electrical path in response to said control signal.

2. An apparatus as defined in claim 1, wherein:

said first variable impedance means includes:

first magnetic amplifier means, having said first electrical path, for causing the impedance of said first electrical path to be relatively low when said control signal includes a net electrical current flowing through said first magnetic amplifier means in a first direction and for causing the impedance of said first electrical path to be relatively high when said control signal includes a net electrical current flowing through said first magnetic amplifier means in a second direction; and second magnetic amplifier means, having said second electrical path, for causing the impedance of said second electrical path to be relatively high when said control signal includes a net electrical current flowing through said second magnetic amplifier means in said first direction and for causing the impedance of said second electrical path to be relatively low when said control signal includes a net electrical current flowing through said second magnetic amplifier means in said second direction;

said second variable impedance means includes third magnetic amplifier means; and said connector means comprises:

means for causing an electrical current flowing in said second electrical path to flow through sad third magnetic amplifier means in a direction relative thereto; and means for causing an electrical current flowing in said first electrical path to flow through said third magnetic amplifier means in a direction relative thereto which is different from the direction of flow of the electrical current flowing in said second electrical path and through said third magnetic amplifier means.

3. An apparatus for controlling electrical characteristics of a three-phase power system when said apparatus is connected to the phase lines of a three-phase power source, said apparatus comprising:

three phase control means for varying the impedance of each of said phase lines, each of said phase control means being associated with a respective one of said phase lines and each of said phase control means including:

first variable impedance means, connectible to at least one source of electrical current, for providing first and second electrical paths through which alternating electrical currents from the at least one source of electrical current can flow, each of said first and second electrical paths having a respective impedance which is variable in response to an effectively direct current control signal; and second variable impedance means for providing a third electrical path having an impedance which is variable in response to currents flowing through said first and second electrical paths, said third electrical path having the phase current of the respective phase line flowing therethrough when said apparatus is connected thereto and said phase current is flowing therein; and control signal means for providing said control signal to said first variable impedance means.

4. An apparatus as defined in claim 3, wherein said control signal means includes direct current means for providing effectively direct current to said first variable impedance means of each of said phase control means in response to the magnitudes of phase currents flowing in said phase lines whereby the impedances of each of said second variable impedance means can be controlled in response to said phase currents so that the magnitudes of said phase currents can be balanced.

5. An apparatus as defined in claim 4, wherein said control signal means further includes comparison means for generating a net limiting direct current when the magnitude of an effective direct current proportional to a selected one of the phase currents of said three-phase power system reaches a predetermined effective direct current magnitude whereby said net limiting direct current causes each of said first variable impedance means to control the impedance of the respective third electrical path of the respectively associated second variable impedance means so that the maximum magnitudes of the phase currents are limited to a predetermined level.

6. An apparatus as defined in claim 3, wherein said control signal means includes comparison means for generating said control signal as a net limiting direct current when the magnitude of an effective direct current proportional to a selected one of the phase currents of said three-phase power system reaches a predetermined effective direct current magnitude whereby said control signal causes each of said first variable impedance means to control the impedance of the respective third electrical path of the respectively associated second variable impedance means so that the maximum magnitude of the selected one of the phase currents is limited to a predetermined level.

7. An apparatus as defined in claim 3, wherein said control signal means includes means for providing said control signal as effectively direct currents which are proportional to voltages between each of the phase lines whereby each of the impedances of said third electrical paths of said second variable impedance means can be controlled in response to the voltages between each of said phase lines so that said voltages can be balanced.

8. An apparatus as defined in claim 7, wherein said control signal means includes comparison means for generating a net limiting direct current when the magnitude of a voltage between a selected pair of the phase lines reaches a predetermined voltage whereby said net limiting direct current causes each of said first variable impedance means to control the impedance of the respective third electrical path of the respectively associated second variable impedance means so that the maximum magnitudes of the voltages between the phase lines are limited to a predetermined level.

9. An apparatus as defined in claim 3, wherein said control signal means includes comparison means for generating said control signal as a net limiting direct current when the magnitude of a voltage between a selected pair of the phase lines reaches a predetermined voltage whereby said control signal causes each of said first variable impedance means to control the impedance of the respective third electrical path of the respectively associated second variable impedance means so that the maximum magnitude of the voltage between the selected pair of phase lines is limited to a predetermined level.

10. An apparatus as defined in claim 3, wherein:

said first variable impedance means includes:

first magnetic amplifier means having first control winding means, first gate winding means and first core means for electromagnetically associating said first control winding means and said first gate winding means; and second magnetic amplifier means having second control winding means, second gate winding means and second core means for electromagnetically associating said second control winding means and said second gate winding means; and said second variable impedance means includes:

third magnetic amplifier means having third control winding means, third gate winding means and third core means for electromagnetically associating said third control winding means and said third gate winding means;

wherein said third control winding means is associated with said first and second gate winding means; and wherein said third gate winding means constitutes at least a part of said third electrical path.

11. An apparatus as defined in claim 10, wherein each of said phase control means further includes:

first rectifier means for limiting current flow in a first direction relative to the respective phase line, said first rectifier means being connectible between the respective phase line and respective first sections of said first and second gate winding means so that the respective phase current is rectified and split between said respective first sections of said first and second gate winding means in a proportion dependent upon the relative impedances provided by said first and second magnetic amplifier means; and second rectifier means for limiting current flow in a second direction relative to the respective phase line, said second rectifier means being connectible between the respective phase line and respective second sections of said first and second gate winding means so that the respective phase current is rectified and split between said respective second sections of said first and second gate winding means in a proportion dependent upon the relative impedances provided by said first and second magnetic amplifier means.

12. An apparatus as defined in claim 11, further comprising pre-biasing means for causing said first magnetic amplifier means to have a relatively high impedance so that relatively little current flows through said first gate winding means when the phase currents are balanced.

13. An apparatus as defined in claim 10, wherein each of said phase control means further includes:

first rectifier means for limiting current flow in a first direction relative to a source of alternating current, said first rectifier means being connectible between the source of alternating current and respective first sections of said first and second gate winding means so that the alternating current is rectified and split between said respective first sections of said first and second gate winding means in a proportion dependent upon the relative impedances provided by said first and second magnetic amplifier means; and second rectifier means for limiting current flow in a second direction relative to a source of alternating current, said second rectifier means being connectible between the source of alternating current and respective second sections of said first and second gate winding means so that the alternating current is rectified and split between said respective second sections of said first and second gate winding means in a proportion dependent upon the relative impedances provided by said first and second magnetic amplifier means.

14. An apparatus as defined in claim 13, further comprising biasing means for causing said third magnetic amplifier means to have a relatively low impedance when the phase currents are balanced.

15. An apparatus as defined in claim 13, wherein said control signal means includes direct current means for providing effectively direct current to said first variable impedance means of each of said phase control means in response to the magnitudes of phase currents flowing in said phase lines whereby the impedances of each of said second variable impedance means can be controlled in response to said phase currents so that the magnitudes of said phase currents can be balanced.

16. An apparatus as defined in claim 13, wherein said control signal means includes comparison means for generating said control signal as a net limiting direct current when the magnitude of an effective direct current proportional to a selected one of the phase currents of said three-phase power system reaches a predetermined effective direct current magnitude whereby said control signal causes each of said first variable impedance means to control the impedance of the respective third electrical path of the respectively associated second variable impedance means so that the maximum magnitude of the selected one of the phase currents is limited to a predetermined level.

17. An apparatus as defined in claim 13, wherein said control signal means includes means for providing said control signal as effectively direct currents which are proportional to voltages between each of the phase lines whereby each of the impedances of said third electrical paths of said second variable impedance means can be controlled in response to the voltages between each of said phase lines so that said voltages can be balanced.

18. An apparatus as defined in claim 13, wherein said control signal means includes comparison means for generating said control signal as a net limiting direct current when the magnitude of a voltage between a selected pair of the phase lines reaches a predetermined voltage whereby said control signal causes each of said first variable impedance means to control the impedance of the respective third electrical path of the respectively associated second variable impedance means so that the maximum magnitude of the voltage between the selected pair of phase lines is limited to a predetermined level.

19. An apparatus as defined in claim 10, wherein each of said phase control means further includes:

first connecting means for providing an effectively direct current to said first gate winding means; and second connecting means for providing an effectively direct current to said second gate winding means.

20. An apparatus for controlling electrical characteristics of a three-phase power system, said apparatus comprising:

first control signal means for providing a first net direct current control signal flowing in either a forward direction or a reverse direction;

first phase control means for controlling a first phase current of said power system, said first phase control means including:

first control reactor means for providing a first variable impedance which is relatively high in response to said first net direct current control signal flowing in said forward direction and which is relatively low in response to said first net direct current control signal flowing in said reverse direction;

second control reactor means for providing a second variable impedance which is relatively low in response to said first net direct current control signal flowing in said forward direction and which is relatively high in response to said first net direct current control signal flowing in said reverse direction;

third control reactor means for providing a third variable impedance which is relatively high in response to said first net direct current control signal flowing in said forward direction and which is relatively low in response to said first net direct current control signal flowing in said reverse direction;

fourth control reactor means for providing a fourth variable impedance which is relatively low in response to said first net direct current control signal flowing in said forward direction and which is relatively high in response to said first net direct current control signal flowing in said reverse direction;

first rectifier means for enabling portions of a first alternating current to flow through said first and second variable impedances during a first part of each cycle of said first alternating current;

second rectifier means for enabling portions of said first alternating current to flow through said third and fourth variable impedances during a second part of each cycle of said alternating current;

first main reactor means for providing a first main variable impedance in response to said portions of said first alternating current flowing through said first, second, third and fourth variable impedances;

second main reactor means for providing a second main variable impedance in response to said portions of said first alternating current flowing through said first, second, third and fourth variable impedances; and means for allowing said first phase current to flow through said first and second main variable impedances;

second control signal means for providing a second net direct current control signal flowing in either a forward direction or a reverse direction;

second phase control means for controlling a second phase current of said power system, said second phase control means including:

fifth control reactor means for providing a fifth variable impedance which is relatively high in response to said second net direct current control signal flowing in said forward direction and which is relatively low in response to said second net direct current control signal flowing in said reverse direction;

sixth control reactor means for providing a sixth variable impedance which is relatively low in response to said second net direct current control signal flowing in said forward direction and which is relatively high in response to said second net direct current control signal flowing in said reverse direction;

seventh control reactor means for providing a seventh variable impedance which is relatively high in response to said second net direct current control signal flowing in said forward direction and which is relatively low in response to said second net direct current control signal flowing in said reverse direction;

eighth control reactor means for providing an eighth variable impedance which is relatively low in response to said second net direct current control signal flowing in said forward direction and which is relatively high in response to said second net direct current control signal flowing in said reverse direction;

third rectifier means for enabling portions of a second alternating current to flow through said fifth and sixth variable impedances during a first part of each cycle of said second alternating current;

fourth rectifier means for enabling portions of said second alternating current to flow through said seventh and eighth variable impedances during a second part of each cycle of said second alternating current;

third main reactor means for providing a third main variable impedance in response to said portions of said second alternating current flowing through said fifth, sixth, seventh and eighth variable impedances;

fourth main reactor means for providing a fourth main variable impedance in response to said portions of said second alternating current flowing through said fifth, sixth, seventh and eighth variable impedances; and means for allowing said second phase current to flow through said third and fourth main variable impedances;

third control signal means for providing a third net direct current control signal flowing in either a forward direction or a reverse direction; and third phase control means for controlling a third phase current of said power system, said third phase control means including:

ninth control reactor means for providing a ninth variable impedance which is relatively high in response to said third net direct current control signal flowing in said forward direction and which is relatively low in response to said third net direct current control signal flowing in said reverse direction;

tenth control reactor means for providing a tenth variable impedance which is relatively low in response to said third net direct current control signal flowing in said forward direction and which is relatively high in response to said third net direct currrent control signal flowing in said reverse direction;

eleventh control reactor means for providing an eleventh variable impedance which is relatively high in response to said third net direct current control signal flowing in said forward direction and which is relatively low in response to said third net direct current control signal flowing in said reverse direction;

twelfth control reactor means for providing a twelfth variable impedance which is relatively low in response to said third net direct current control signal flowing in said forward direction and which is relatively high in response to said third net direct current control signal flowing in said reverse direction;

fifth rectifier means for enabling portions of a third alternating current to flow through said ninth and tenth variable impedances during a first part of each cycle of said third alternating current;

sixth rectifier means for enabling portions of said third alternating current to flow through said eleventh and twelfth variable impedances during a second part of each cycle of said third alternating current;

fifth main reactor means for providing a fifth main variable impedance in response to said portions of said third alternating current flowing through said ninth, tenth, eleventh and twelfth variable impedances;

sixth main reactor means for providing a sixth main variable impedance in response to said portions of said third alternating current flowing through said ninth, tenth, eleventh and twelfth variable impedances; and means for allowing said third phase current to flow through said fifth and sixth main variable impedances.

21. An apparatus as defined in claim 20, wherein the portions of said first alternating current flowing through said first and third variable impedances flow in association with said first and second main reactor means in a direction relative thereto which is opposite the direction that the portions of said first alternating current flowing through said second and fourth variable impedances flow relative to said first and second main reactor means.

22. An apparatus as defined in claim 20, wherein:

said first phase control means further includes:

first short-circuit means associated with said first and third control reactor means;

second short-circuit means associated with said second and fourth control reactor means; and third short-circuit means associated with said first and second main reactor means;

said second phase control means further includes:

fourth short-circuit means associated with said fifth and seventh control reactor means;

fifth short-circuit means associated with said sixth and eighth control reactor means; and sixth short-circuit means associated with said third and fourth main reactor means; and said third phase control means further includes:

seventh short-circuit means associated with said ninth and eleventh control reactor means;

eighth short-circuit means associated with said tenth and twelfth control reactor means; and ninth short-circuit means associated with said fifth and sixth main reactor means.

23. An apparatus as defined in claim 20, wherein:

said first rectifier means includes:

a first diode having an anode connectible to a first phase line through which said first phase current flows and having a cathode connected to said first control reactor means; and a second diode having an anode connectible to said first phase line and having a cathode connected to said second control reactor means;

said second rectifier means includes:

a third diode having a cathode connectible to said first phase line and having an anode connected to said third control reactor means; and a fourth diode having a cathode connectible to said first phase line and having an anode connected to said fourth control reactor means;

said third rectifier means includes:

a fifth diode having an anode connectible to a second phase line through which said second phase current flows and having a cathode connected to said fifth control reactor means; and a sixth diode having an anode connectible to said second phase line and having a cathode connected to said sixth control reactor means;

said fourth rectifier means includes:

a seventh diode having a cathode connectible to said second phase line and having an anode connected to said seventh control reactor means; and an eighth diode having a cathode connectible to said second phase line and having an anode connected to said eighth control reactor means;

said fifth rectifier means includes:

a ninth diode having an anode connectible to a third phase line through which said third phase current flows and having a cathode connected to said ninth control reactor means; and a tenth diode having an anode connectible to said third phase line and having a cathode connected to said tenth control reactor means; and said sixth rectifier means includes:

an eleventh diode having a cathode connectible to said third phase line and having an anode connected to said eleventh control reactor means; and a twelfth diode having a cathode connectible to said third phase line and having an anode connected to said twelfth control reactor means.

24. An apparatus as defined in claim 20, wherein each of said first, second and third control signal means is responsive to said first, second and third phase currents.

25. An apparatus as defined in claim 20, wherein each of said first, second and third control signal means is responsive to phase voltages between each set of two phases of said three-phase power system.

26. An apparatus as defined in claim 20, wherein each of said first, second and third control signal means is responsive to a comparison between a selected one of said first, second and third phase currents and a predetermined current magnitude.

27. An apparatus as defined in claim 20, wherein each of said first, second and third control signal means is responsive to a comparison between a voltage between a selected pair of the phases of said three-phase power system and a predetermined voltage magnitude.

* * * * *

UNITED STATES PATENT AND TRADEMARK OFFICE

CERTIFICATE OF CORRECTION

PATENT NO. : 4,574,231

DATED : March 4, 1986

INVENTOR(S) : Donald W. Owen

It is certified that error appears in the above-identified patent and that said Letters Patent are hereby corrected as shown below:

Column 2, line 67, change "age" to --ages--.

Column 5, line 27, change "3i" to --36--.

Column 6, line 18, change "mechanism" to --mechanisms--.

Column 12, line 22 (claim 2), change "sad" to --said--.

Signed and Sealed this

*Seventeenth* Day of *June 1986*

[SEAL]

*Attest:*

DONALD J. QUIGG

*Attesting Officer*

*Commissioner of Patents and Trademarks*